US005469670A

United States Patent [19]

Thaler

[11] Patent Number: 5,469,670

[45] Date of Patent: Nov. 28, 1995

[54] ROOF DRAIN

[76] Inventor: Kunibert Thaler, 32/33 Maplewood Dr., RR #1, Parry Sound, Ontario P2A 2W7, Canada

[21] Appl. No.: 95,021

[22] Filed: Jul. 22, 1993

[51] Int. Cl.[6] ..... B04D 13/00; B03F 5/06

[52] U.S. Cl. ..... 52/12; 52/20; 210/163; 210/166; 210/460

[58] Field of Search ..... 52/12, 198, 199, 52/96, 20; 210/163–166, 232, 247, 452, 460

[56] References Cited

U.S. PATENT DOCUMENTS

| | | | |
|---|---|---|---|
| 1,791,512 | 2/1931 | Schurman | 210/166 |
| 2,284,416 | 5/1942 | Gordon | 210/166 |
| 2,783,852 | 3/1957 | Sisk | 210/165 |
| 3,349,917 | 10/1967 | Strickland | 210/164 |
| 3,469,698 | 9/1969 | Blendermann | 52/12 |
| 3,909,412 | 9/1975 | Patry | 210/166 |
| 4,035,297 | 7/1977 | Aldridge et al. | 210/163 |
| 4,257,892 | 3/1981 | Boersma | 210/163 |
| 4,505,814 | 3/1985 | Marshall | 210/166 |
| 4,507,203 | 3/1985 | Johnston | 210/453 |
| 4,525,273 | 6/1985 | Logsdon | 210/164 |

*Primary Examiner*—Carl D. Friedman
*Assistant Examiner*—Winnie B. Yip
*Attorney, Agent, or Firm*—Evenson, McKeown, Edwards & Lenahan

[57] ABSTRACT

A roof drain for draining rainwater from a roof. A bell-like strainer is supported by a compression/tension unit including resilient means, which unit is in turn mounted to a drainage sleeve that communicates with a leader. The strainer is secured to the drainage sleeve by a threaded bolt that passes through bores in the strainer and the compression/tension unit, and engages a nut received by the resilient means. Tightening the bolt moves the strainer downwardly into a substantially watertight fit with roofing membrane interposed between a skirt of the strainer and a collar on the drainage sleeve. The resilient means, which may be resilient material, a spring or the like, provides continuous tension between the strainer and the drainage sleeve.

25 Claims, 9 Drawing Sheets

ROOF DRAIN

FIELD OF THE INVENTION

This invention relates to devices for draining rainwater and the like from a roof. In particular, it pertains to devices that protrude above the plane of the roof and are mounted to a leader below the plane of the roof.

BACKGROUND OF THE INVENTION

It is well-known in the building trades to install on a roof a drainage device that communicates with a drainpipe or leader below the surface of the roof, for removing rainwater and the like. Such a device must provide a watertight connection with the leader and with the surface of the roof, so that water is prevented from leaking below the roof and causing damage.

A typical type of roof drain has a dome type strainer with vertical drainage slots on all sides. The diameter of the strainer is greater than that of the vertical leader with which it is used. A horizontal ting portion that is flat on its bottom surface is integral with the base of the strainer. The ring portion extends inwardly of the domed portion of the strainer to define a drainage outlet that is slightly smaller in diameter than the leader. The ring portion also extends outwardly of the domed portion defining a flange.

In use, the ring portion of the strainer is mounted to a separate clamping ring that encircles the leader below the surface of the roof. The clamping ring has top and bottom flat horizontal ring portions that are similar in size to the strainer ting portion. Typically, the strainer has several lugs that protrude as extensions of the flange at its base. The clamping ting used with it has the same size or slightly larger openings in its top ting portion. The strainer is lowered onto the clamping ring such that the lugs pass through the openings in the top ring portion. The strainer is then turned so that the lugs are between the top and bottom ting portions. Thus, it cannot be directly lifted out of engagement with the leader. Bolts are used to secure the strainer ring portion to the top and bottom ting portions of the clamping ring, each bolt passing through all three ring portions. Such mounting must be watertight.

Separate mounting of the clamping ring and the strainer of this type of device requires skill. It is typically performed by a plumber, rather than by a roofer or by some unskilled individual.

SUMMARY OF THE INVENTION

In a first aspect, the present invention provides a roof drain for use with a leader, having a strainer, a drainage sleeve, fastening means for securing the strainer to the drainage sleeve and resilient means for providing continuous tension between the strainer and the drainage sleeve. The strainer and the drainage sleeve are each adapted so that when they are secured to each other, water can drain through the strainer and the drainage sleeve into the leader. The strainer and the drainage sleeve may each be adapted to form a substantially watertight seal with the other. The resilient means may be supported and retained by a frame of a compression/tension unit.

In a second aspect, the present invention provides a roof drain for use with a leader, having a strainer, a drainage sleeve and a compression/tension unit including resilient means for providing continuous tension between the strainer and the drainage sleeve. The strainer and the drainage sleeve are each adapted for mounting to the compression/tension unit in such a manner that water draining from the roof passes through the strainer, the compression/tension unit and the drainage sleeve into the leader. The strainer and the drainage sleeve may each be adapted to receive roofing membrane interposed therebetween, to provide a substantially watertight seal.

BRIEF DESCRIPTION OF THE DRAWINGS

For a better understanding of the present invention and to show more clearly how it may be carded into effect, reference will now be made by way of example to the accompanying drawings, which show preferred embodiments of the present invention and in which.

DETAILED DESCRIPTION OF THE PREFERRED EMBODIMENTS

Figure 1:
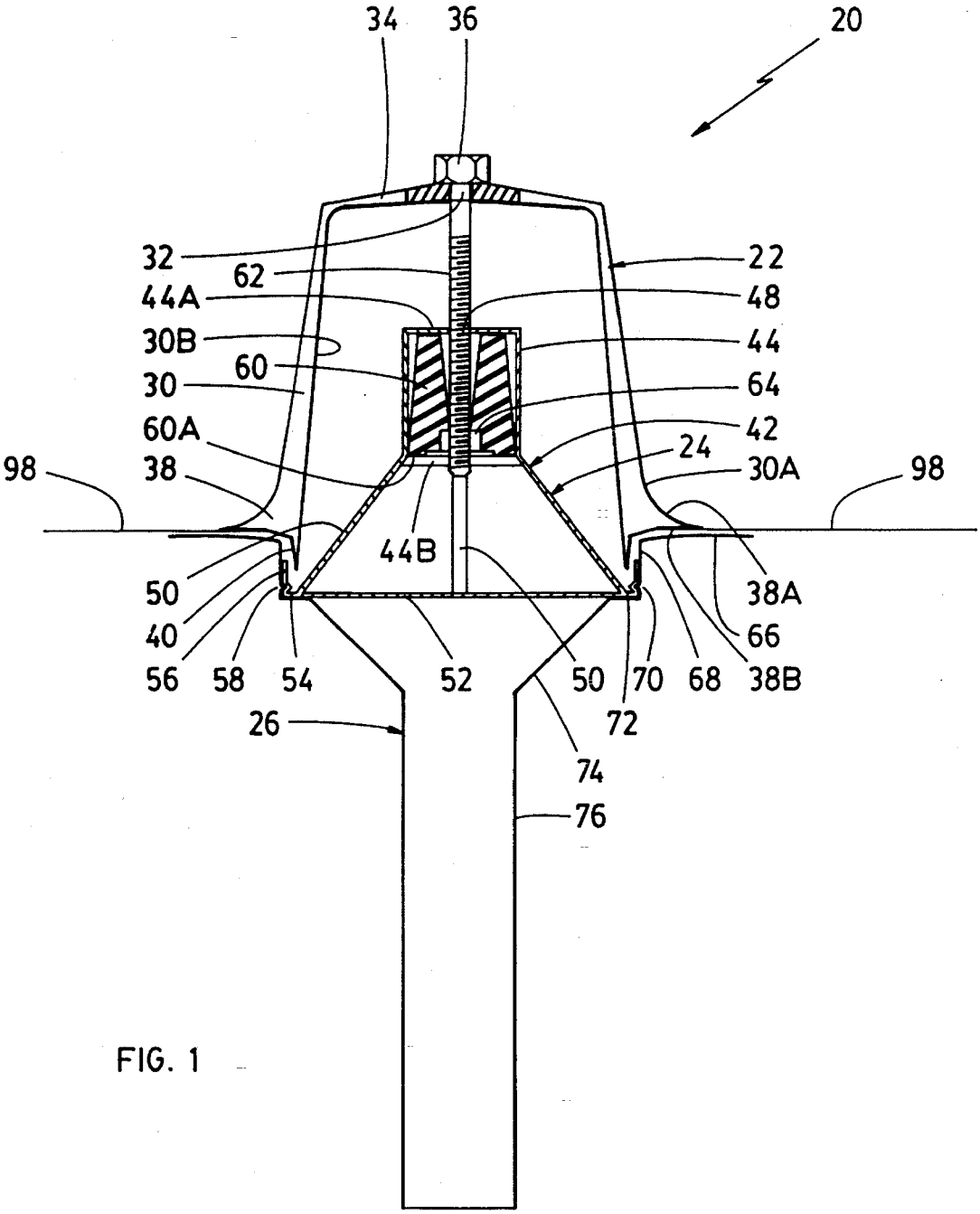
FIG. 1 is a cross-sectional side elevation of a roof drain according to a first preferred embodiment of the present invention.

Referring to FIG. 1, a roof drain 20 has a dome type strainer 22, a compression/tension unit 24 and a drainage sleeve 26.

Figure 2:
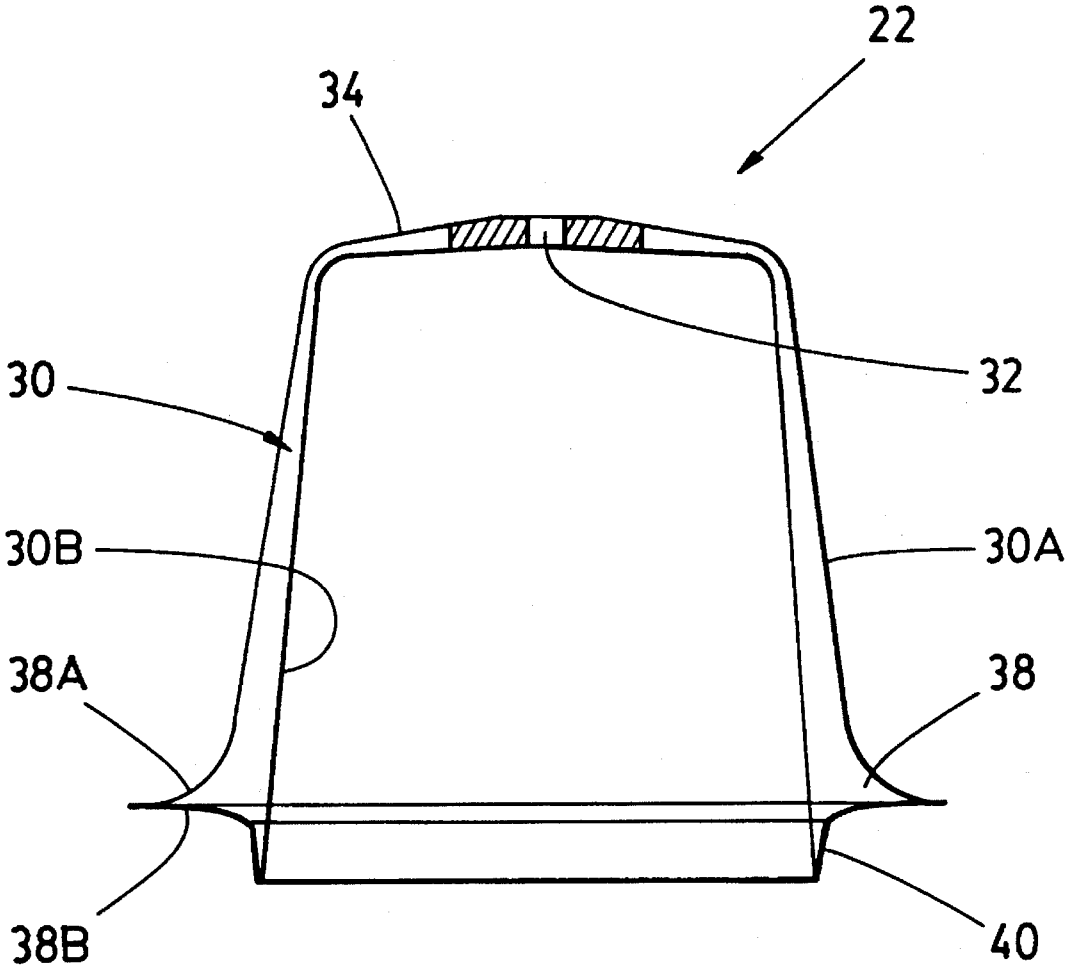
FIG. 2 is a cross-sectional side elevation of the strainer of the device of FIG. 1.
Figure 3:
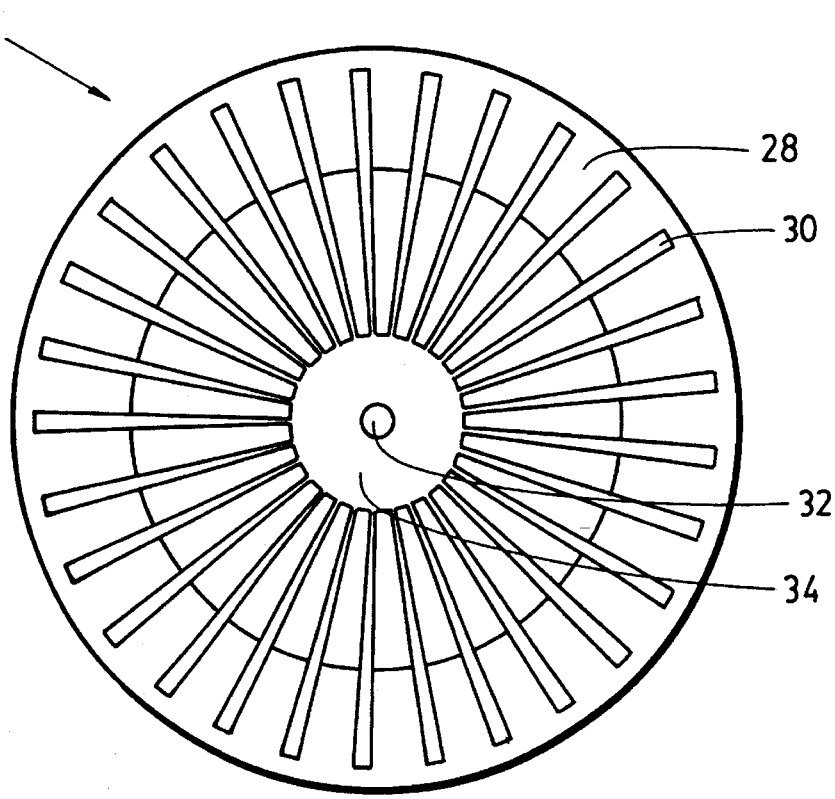
FIG. 3 is a top plan view of the strainer of FIG. 2.

As shown in FIGS. 2 and 3, the strainer 22 has a bell-like shape, vertical slots 28 on all sides 30 and a hole 32 in its top 34 for receiving threaded bolt 36, which bolt is shown in FIG. 1. The slots 28 allow water to drain into the device 20 while blocking the passage of any debris that might clog the device 20. Outer surface **30*a* of the sides 30 flares outwardly near the bottom of the strainer 22 to define a skirt 38 having a top side 38*a* and a bottom side 38*b*. The skirt 38 has a radius such that the bottom side 38*b* slopes downwardly and inwardly. Substantially perpendicular to the bottom skirt side 38*b* and extending downwardly therefrom is a lip 40. Inner surface 30*b* of the sides 30 coincides with inner surface of the lip 40**.

Figure 4:
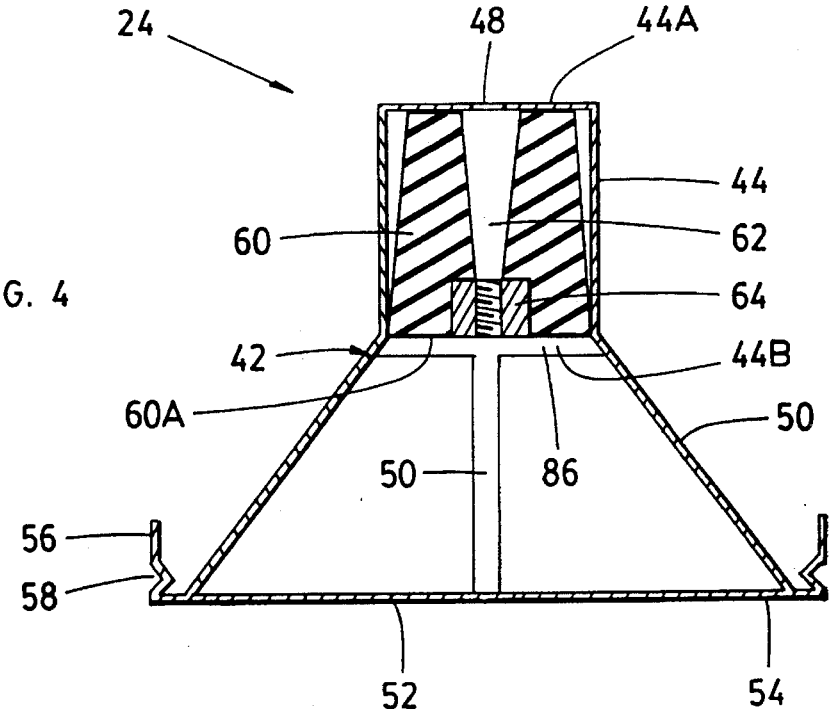
FIG. 4 is a cross-sectional side elevation of the compression/tension unit of the device of FIG. 1.
Figure 5:
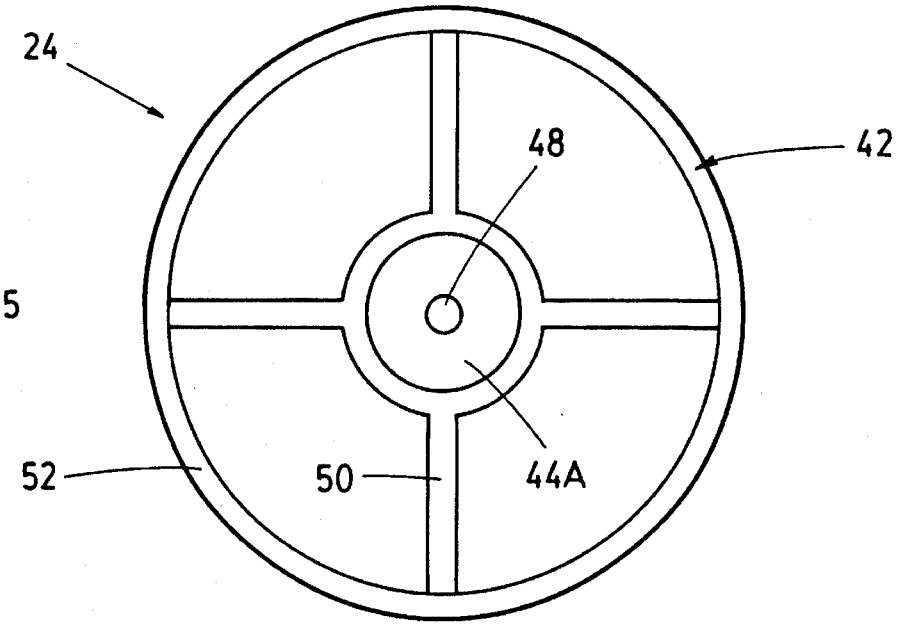
FIG. 5 is a top plan view of the compression/tension unit of the device of FIG. 1.

As shown in FIGS. 4 and 5, the compression/tension unit 24 includes a frame 42 having a cylindrical tension holder 44 as its upper portion. Top side **44*a* of the tension holder 44 is solid with a central hole 48 for receiving a bolt 36, as shown in FIG. 1, and bottom side 44*b*** is substantially open.

Referring again to FIG. 4, the lower portion of the frame 42 includes struts 50 projecting downwardly and outwardly in radial arrangement from the bottom side 44*b* of the tension holder 44. The frame 42 also includes a ring 52 that is integral with the lower end of each of the struts 50. The ring 52 extends laterally outwardly beyond the ends of the struts 50 in a flange 54. The outer edge of the flange 54 terminates in a circular rim 56 that extends upwardly and substantially perpendicularly from the flange 54. The rim 56 has a groove 58, the concave side of the groove 58 being on the exterior surface of the rim 56. The diameter of the rim 56 is slightly larger than the diameter of the lip 40 of the strainer 22.

The tension holder 44 of the compression/tension unit 24 supports and retains resilient means 60. Bottom 60*a* of the resilient means 60 has a circumference that slightly exceeds the circumference of the bottom side 44*b* of the tension holder 44. The resilient means 60 tapers inwardly towards its top. Thus, the resilient means 60 can be inserted in the tension holder 44 through the bottom side 44*b*, and slight compression of its bottom 60*a* retains the resilient means 60 in place inside the tension holder 44.

The resilient means 60 has a central region 62 for receiving a threaded nut 64 that engages the bolt 36. In this embodiment of the invention, fastening means for securing the strainer 22 to the drainage sleeve is the bolt 36 and the nut 64; however, other suitable fastening means can be used in other embodiments.

Figure 6:
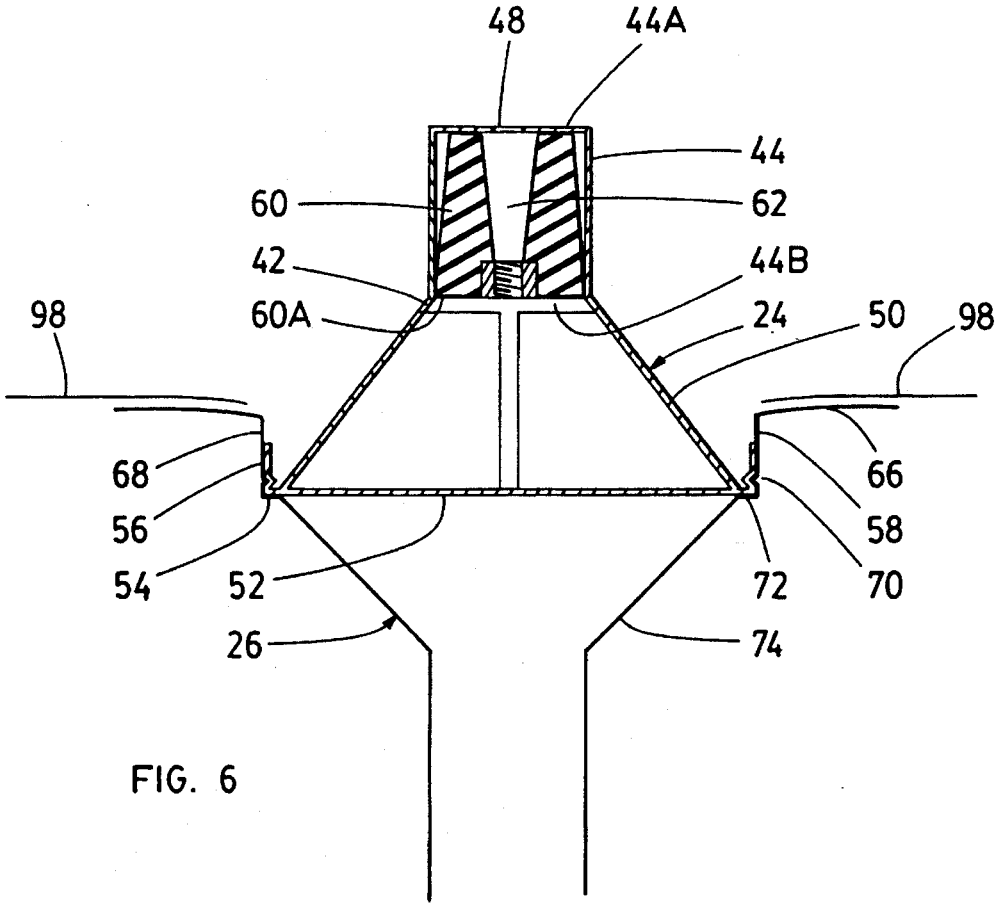
FIG. 6 is a cross-sectional side elevation of the compression/tension unit and the drainage sleeve of the device of FIG. 1.

As shown in FIG. 6, the drainage sleeve 26 has, at its top, a horizontal annular collar 66. The collar 66 has a radius that corresponds in contour to the radius of the skirt 38. A wall 68 extends downwardly and substantially perpendicularly from the interior edge of the collar 66. The wall 68 has a bead 70 that projects from its interior surface, the bead 70 being sized to mate with the groove 58 of the rim 56. In this embodiment of the invention, them is a single continuous groove 58 about the rim 56 and a single continuous bead 70 about the wall 68. In other embodiments, there may be more than one groove 58 and more than one bead 70, each being spaced appropriately for mating engagement with the other.

From the base of the wall 68, a small flange 72 extends inwardly, and from the interior edge of the flange 72, funnel-shaped walls 74 extend downwardly and inwardly. A cylindrical conduit 76 extends from the lower edge of the funnel-shaped walls 74.

The collar 66, the wall 68, the flange 72, the funnel-shaped walls 74 and the conduit 76 are integral with each other. The outer edge of the collar 66 defines a circle that is larger than that defined by the outer edge of the skin 38 of the strainer 22. The circle defined by the wall 68 is slightly larger than that defined by the rim 56, such that the latter can make a forced snap-fit into the former, with engagement of the bead 70 and the groove 58. The circle defined by the lip 40 of the strainer 22 is smaller than that defined by the rim 56.

Conveniently, to mount the roof drain 20 on a leader, not shown, the conduit 76, which is of a smaller cross-sectional area than the leader, is lowered into the leader, and the two are mechanically connected by suitable means. Roofing membrane 98, for example of ethylene propylene diene monomer polymers (EPDM), is laid over the collar 66. The membrane is cut to provide an opening having a circumference that is substantially the same as that of the inner edge of the collar 66. The compression/tension unit 24 is then mounted on the drainage sleeve 26 by engagement of the bead 70 and the groove 58. Alternatively, the compression/tension unit and the drainage sleeve 26 may be mounted together prior to lowering the conduit 76 into the leader.

The strainer 22 is then lowered over the compression/tension unit 24, which supports the strainer 22. The bolt 36 is passed through the hole 32 in the top 34 of the strainer 22, the hole 48 in the top side 44*a* of the tension holder 44 and the bottom side 44*b*. The bolt 36 is turned to engage the nut 64 that is received in the bottom 60*a* of the resilient means 60. The process of turning the bolt 36 produces downward movement of the strainer 22. The bottom skirt side 38*b* presses downwardly, compressing the roofing membrane, not shown, against the correspondingly contoured top side of the collar 66 to provide an even, substantially watertight seal. The resilient means 60 maintains continuous tensioning pressure between the strainer 22 and the drainage sleeve 26.

The tension provided by the resilient means 60 also helps to protect against overtightening of the bolt 36 during installation. Thus, the frame 42 is prevented from moving upwardly during overtightening, which would pop the groove 70 and bead 58 out of engagement.

Figure 7:
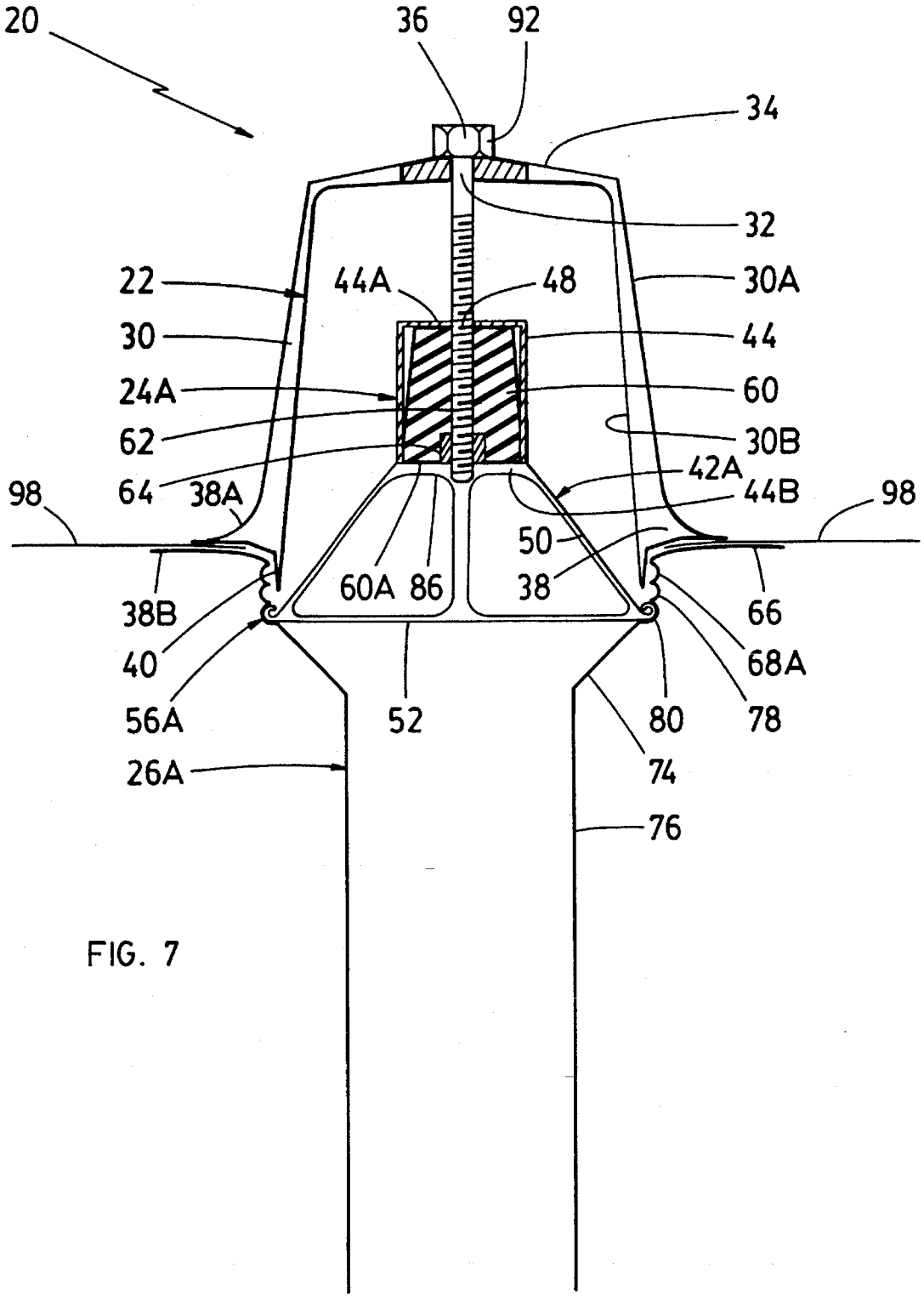
FIG. 7 is a cross-sectional side elevation of a roof drain according to a second preferred embodiment of the invention.
Figure 8:
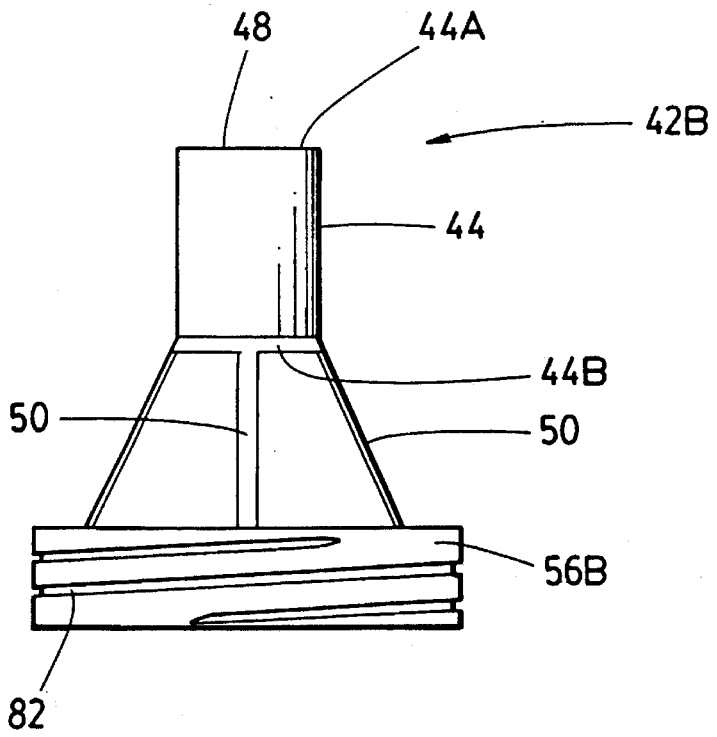
FIG. 8 is an exploded side elevation of the compression/tension unit frame and the drainage sleeve of a third preferred embodiment of the invention.
Figure 8:
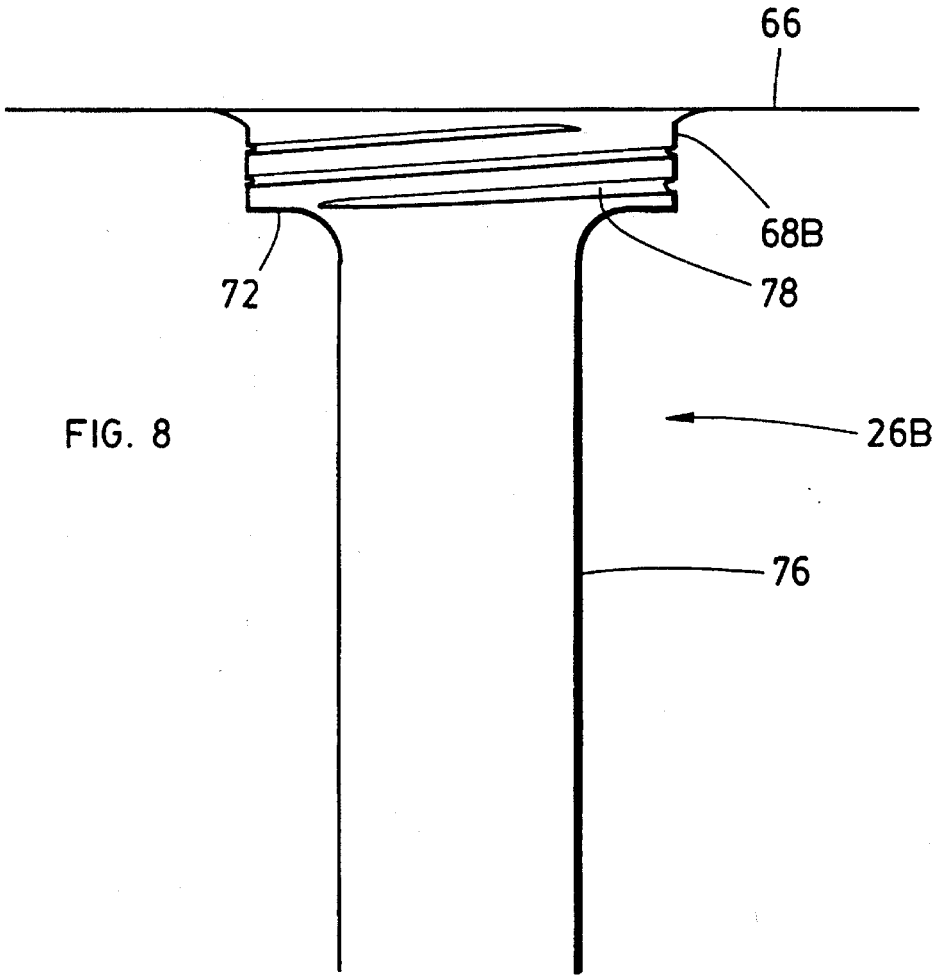

FIGS. 7 and 8 show second and third preferred embodiments of the present invention. Here, drainage sleeves 26A and 26B are respectively threaded 78 for engagement with compression/tension units 24A and 26B. The compression/tension unit 24A, shown in FIG. 7, has a rim 56A with a rolled edge 80 that corresponds in size to the threading 78 of the wall 68A of the drainage sleeve 26A. Frame 42B, shown in FIG. 8, of the compression/tension unit 24B has threading 82 on its rim 56B for mating engagement with the threading 78 of the wall 68B of the drainage sleeve 26B.

When mounting the roof drain 20 according to the second or third embodiments of the invention, the drainage sleeve 26A, 26B can be first lowered into the leader, not shown, and the roofing membrane 98, can be cut to an appropriate size for a watertight seal with the roof drain 20. The compression/tension unit 24A, 24B can then be screwed to the drainage sleeve 26A, 26B, prior to mounting the strainer 22, as previously described.

Figure 9:
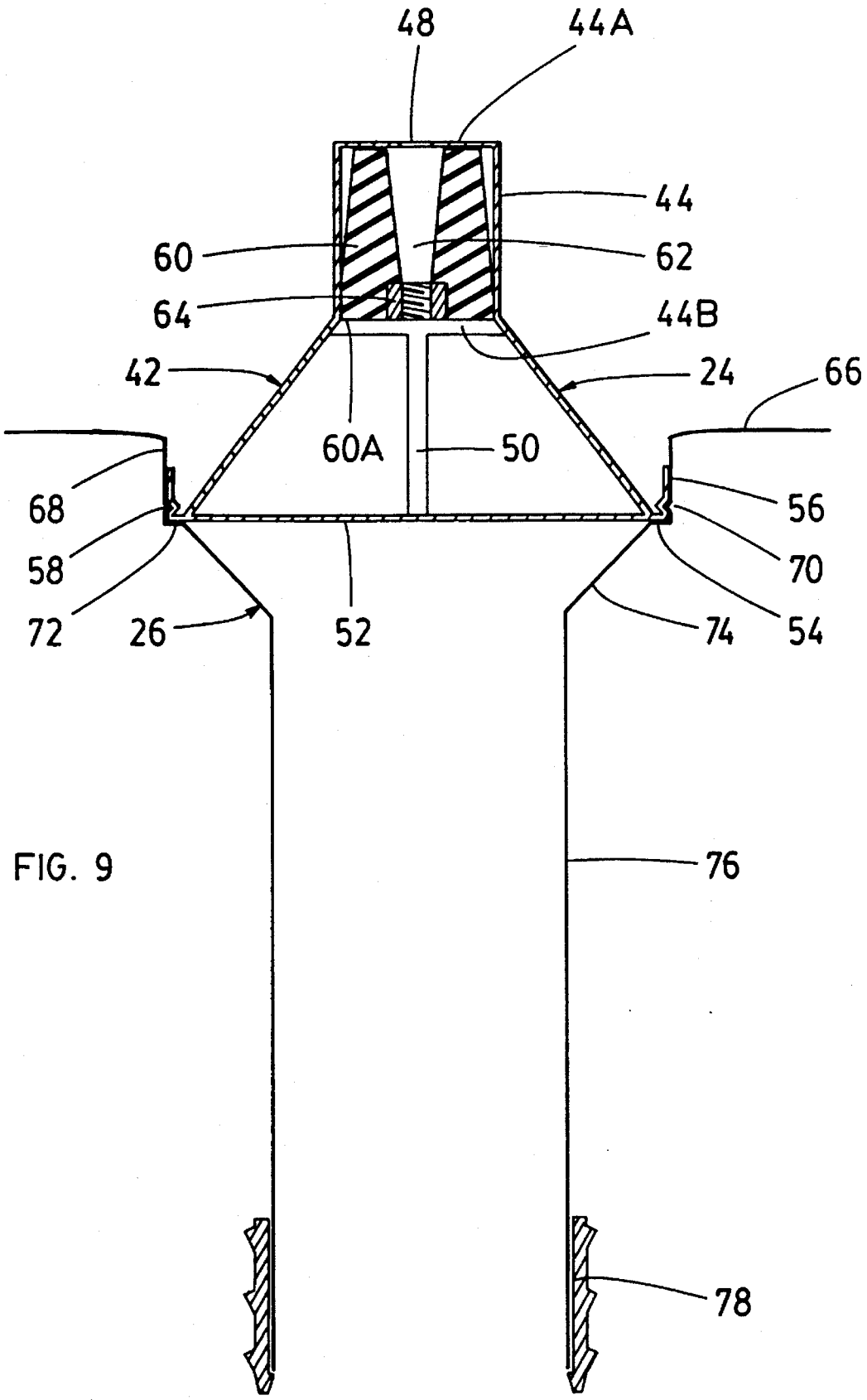
FIG. 9 is a cross-sectional side elevation of the compression/tension unit of FIG. 4 mounted to a wide drainage sleeve.

Different sizes of conduits 76 are shown in FIGS. 6 and 9 for use with different sizes of leaders. FIG. 9 also shows a sleeve connector 84 for mechanical attachment of the conduit 76 and the leader.

In operation, water such as rainwater passes through the slots 28 in the strainer, and then through the passages between the struts 50, into the conduit 76, and then into the leader. The smaller size of the circle defined by the lip 40 relative to those circles defined by the rim 56 and the wall 68, and the overlapping vertical placement of the lip 40 and the rim 56 ensure that the water will drain downwardly, without lateral leakage into the roofing material.

Figure 10:
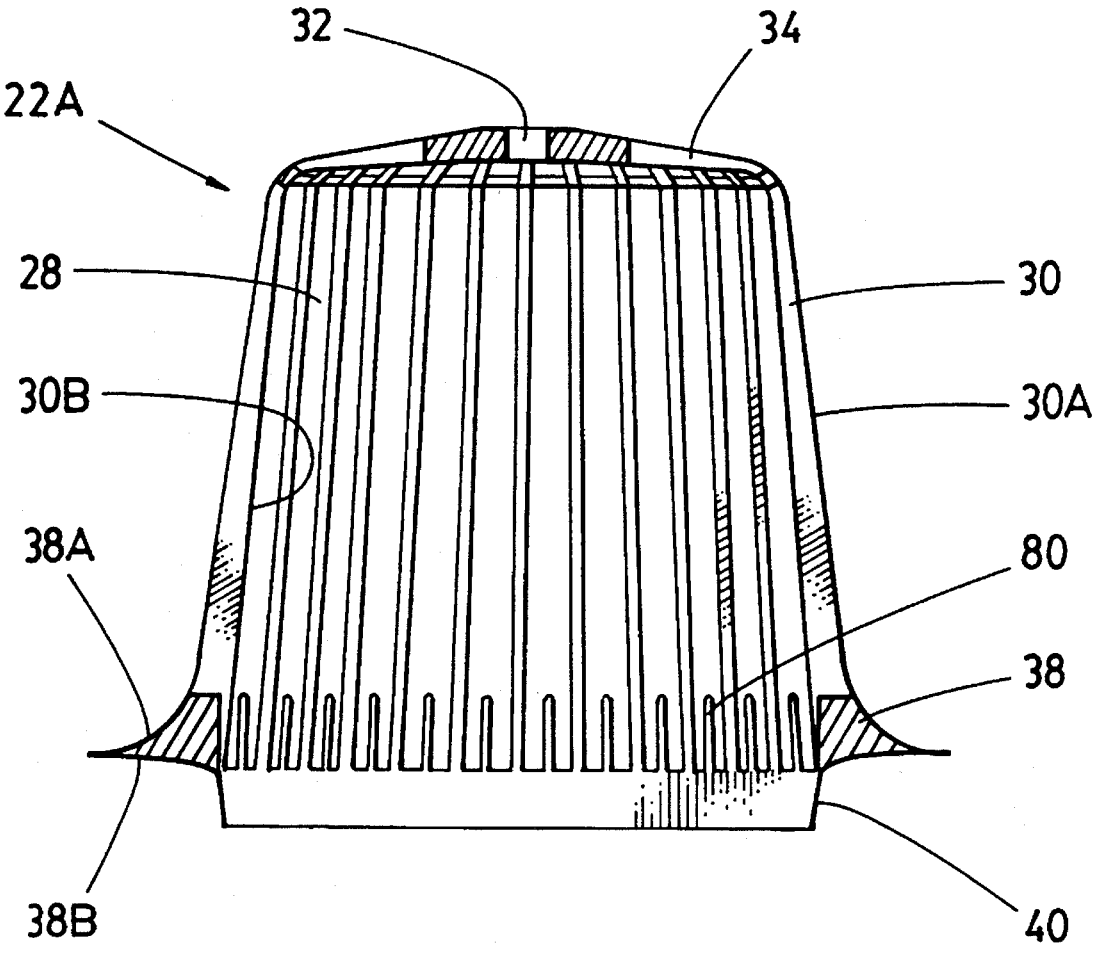
FIG. 10 is a side elevation of second embodiment of a strainer according to the present invention.
Figure 11:
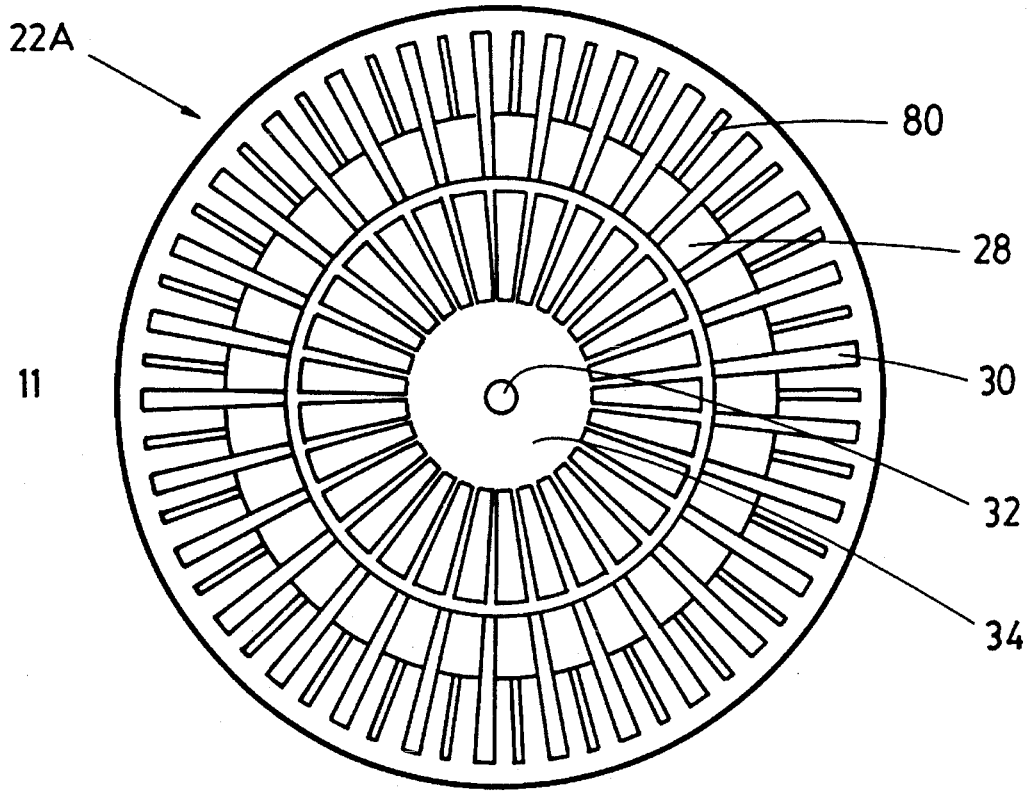
FIG. 11 is a top plan view of the strainer of FIG. 10.

FIGS. 10 and 11 show an alternative embodiment of a strainer 22A according to the present invention. Here, a fin 80 extends upwardly a short distance above the skirt 38 in each of the slots 28. The integral fins 80 aid in preventing gravel from entering the strainer 22A. In other embodiments of the present invention, the strainer 22 may not have a bell-shape, but another convenient and regular shape.

In certain embodiments of the invention, the resilient means 60 may be disposed directly below the strainer top 34. It could, for instance, be positioned above the top side 44*a* of the tension holder 44.

In some embodiments of the invention, the compression/tension unit 24 may have separate, rather than integral components, for example, separate tension holder 44, struts 50 and ting 52.

The strainer 22 may be of aluminum, bronze or stainless steel, and the drainage sleeve 26 may be of aluminum, copper, stainless steel, iron, polyvinyl chloride or another plastic. The frame 42 of the compression/tension unit 24 may be of aluminum, copper, stainless steel or iron. Other suitable materials may be substituted for each of these components. The resilient means 60 may be a resilient material such as rubber, a spring 85 or other suitable means. The bolt 36 is preferably of the one-directional vandal-proof type, though other suitable fastening means may be used.

When assembled, holder 44, having resilient member 60 received within its downwardly open portion 86, is generally centered above upper surrounding collar 66 of the drainage sleeve and skirt rim **38*b*. Communicating apertures 62, 48, 32 of the resilient member, top wall 44*a* of the holder, and top wall 34 of the strainer, respectively, through which the shank of bolt 36 passes, are located in the center of the arrangement. Bolt 36 is threaded through nut 64. A lower head, enlarged with respect to the opening in the resilient member through which the upper shank portion is inserted, is provided by nut 64 and is drawn upwardly when the bolt is turned in the appropriate direction (typically in the clockwise direction as viewed from above). Such turning of the bolt with respect to the nut causes the nut to be drawn upwardly to compress the resilient member between the head and the top wall of the holder. Bolt head 92, pressing down on the top wall of the strainer, in turn, forces rim 38*b* in a downward direction against roofing membrane 98 and drainage sleeve collar 66. Arrangement of the circular skirt rim and collar concentrically about the tightening means provided by the threading engagement of the nut and bolt provides for an even distribution of downward acting sealing forces, which are adjusted, as required, by appropriate turning of the bolt. A watertight seal between the membrane and collar is thus obtainable through the adjustment of a bolt. Bolt head 92**, being located above the top wall of the strainer, is accessible for adjustment after the entire assembly is in place.

In contrast to conventional roof drains, the roof drain 20 of the present invention can be easily, quickly and economically installed without requiring special expertise on the part of the person performing the installation. A snug connection between the strainer 22 and the drainage sleeve 26 is maintained by the tension of the resilient means 60.

The roof drain 20 can be adapted for use with leaders of varying sizes and may also be used for retrofitting of previously installed drains.

It will be understood that this description is made with reference to the preferred embodiment of the invention. However, it is possible to make other embodiments that employ the principles of the invention and that fall within its spirit and scope as defined by the following claims.

What is claimed is:

1. A roof drain for use with a leader, comprising:

a strainer;

a drainage sleeve;

fastening means for securing the strainer to the drainage sleeve so that water can drain through the strainer and the drainage sleeve into the leader; and a compression/tension unit including resilient means for providing continuous tension between the strainer and the drainage sleeve, and a frame that supports and retains the resilient means, the frame including:

a rim for mounting the frame to the drainage sleeve;

a tension holder that retains the resilient means; and radial struts that extend downwardly from the tension holder to connect the tension holder to the rim;

wherein the strainer and the drainage sleeve form a substantially watertight seal with each other.

2. The room drain of claim 1, wherein the drainage sleeve has a collar at an end, which collar forms said substantially watertight seal with the strainer.

3. The roof drain of claim 2, wherein the strainer has a skirt at its base which skirt forms said substantially watertight seal with the collar of the drainage sleeve.

4. The roof drain of claim 3, wherein the collar has a greater diameter than the skirt.

5. The roof drain of claim 4, wherein the strainer is substantially bell-shaped.

6. The roof drain of claim 5, wherein the strainer has vertical slots, each slot having a fin at the slot's bottom.

7. The room drain of claim 1, wherein the struts of the frame extend radially outwardly from the tension holder to the rim.

8. The roof drain of claim 1, wherein the drainage sleeve has a wall which engages the rim of the compression/tension unit.

9. The roof drain of claim 8, wherein the rim has a groove having a concave side on the outer surface of the rim.

10. The roof drain of claim 9, wherein the wall of the drainage sleeve has a bead in snap-fit engagement with the groove.

11. The roof drain of claim 8, wherein the wall of the drainage sleeve is threaded.

12. The roof drain of claim 11, wherein the rim has threading in engagement with the threading of the wall.

13. The roof drain of claim 11, wherein the rim has a rolled edge adapted to engage the threading of the wall.

14. The roof drain of claim 8, wherein the drainage sleeve includes funnel-shaped walls integral with the wall.

15. The roof drain of claim 14, wherein the drainage sleeve includes a conduit integral with the funnel-shaped walls, the conduit for receiving water that passes between the funnel-shaped walls.

16. The roof drain of claim 1, wherein the fastening means includes a threaded bolt.

17. The roof drain of claim 16, wherein the threaded bolt is engaged by a threaded nut received by the resilient means.

18. The roof drain of claim 1, wherein the resilient means includes resilient material.

19. The roof drain of claim 1, wherein the resilient means includes a spring.

20. The roof drain of claim 1, wherein the strainer and the drainage sleeve are each adapted to receive roofing membrane interposed therebetween, to provide a substantially watertight seal.

21. A roof drain for use with a leader, comprising:

a drainage sleeve having a lower end for receipt within the leader and an upper surrounding collar;

a holder connected to the sleeve and centered above the collar, the holder having a downwardly open portion receiving a resilient member therein and a top wall having a central aperture therein;

a strainer for mounting atop the sleeve, the strainer having a lower rim which mates with the collar of the sleeve for receipt of a roofing membrane therebetween and a top wall located above the top wall of the holder and having an aperture located above the aperture of the top wall of the holder;

a said resilient member received within the downwardly open portion of the holder, the resilient member having an upright central axial aperture running from end to end, the respective apertures of the resilient member, the holder and the strainer being in communication with each other;

a fastener extending through the communicating apertures, the fastener having a lower enlarged head and an upper tightening means above the top wall of the strainer connected to the head for drawing the head upwardly toward the top wall of the holder to compress the resilient member therebetween so as to generate a downwardly acting force on the strainer through the tightening means and thereby force the rim of the strainer downwardly against said roofing membrane located between the rim and collar to provide a watertight seal between the membrane and collar.

22. The drain of claim 21, wherein the fastener includes a bolt having a lower threaded portion and a nut onto the threaded portion, and the tightening means includes a bolt head in abutment with the top wall of the strainer.

23. The drain of claim 21, wherein the lower enlarged head of the fastener includes a nut threaded onto a lower end of the bolt.

24. The drain of claim 21, wherein the resilient member is of rubber.

25. The drain of claim 21, wherein the resilient member is a spring.

* * * * *

UNITED STATES PATENT AND TRADEMARK OFFICE

CERTIFICATE OF CORRECTION

PATENT NO. : 5,469,670

DATED : November 28, 1995

INVENTOR(S) : Kunibert THALER

It is certified that error appears in the above-indentified patent and that said Letters Patent is hereby corrected as shown below:

In the Drawings, please change

" 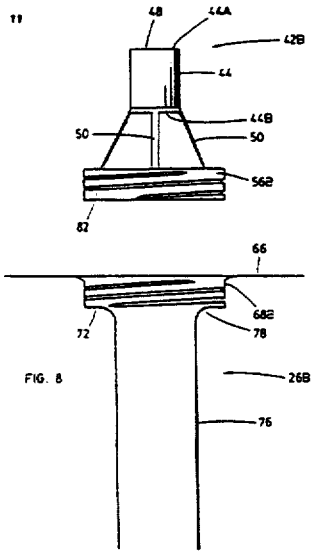

FIG. 8

" to -- 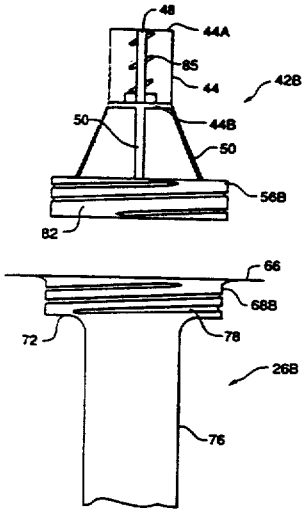

FIG.8 --

Signed and Sealed this

Eighteenth Day of February, 1997

*Attest:*

BRUCE LEHMAN

*Attesting Officer*

*Commissioner of Patents and Trademarks*